US011628960B2

(12) United States Patent
Fischer et al.

(10) Patent No.: US 11,628,960 B2
(45) Date of Patent: Apr. 18, 2023

(54) MULTIPACK HAVING ADHESIVELY BONDED CONTAINERS AND A CARRYING HANDLE

(71) Applicant: KHS GmbH, Dortmund (DE)

(72) Inventors: Mathias Fischer, Kevelaer (DE); Uwe Hoffmann, Böbingen an der Rems (DE)

(73) Assignee: KHS GmbH, Dortmund (DE)

( * ) Notice: Subject to any disclaimer, the term of this patent is extended or adjusted under 35 U.S.C. 154(b) by 1036 days.

(21) Appl. No.: 15/542,991

(22) PCT Filed: Jan. 7, 2016

(86) PCT No.: PCT/EP2016/050236

§ 371 (c)(1),
(2) Date: Jul. 12, 2017

(87) PCT Pub. No.: WO2016/113182

PCT Pub. Date: Jul. 21, 2016

(65) Prior Publication Data

US 2018/0009557 A1 Jan. 11, 2018

(30) Foreign Application Priority Data

Jan. 12, 2015 (DE) ..... 10 2015 100 342.2

(51) Int. Cl.
*B65D 71/52* (2006.01)
*B65B 17/02* (2006.01)
*B65D 21/02* (2006.01)

(52) U.S. Cl.
CPC ..... *B65B 17/025* (2013.01); *B65D 21/0205* (2013.01)

(58) Field of Classification Search
CPC .... B65D 21/02; B65D 21/024; B65D 21/028; B65D 5/4275; B65D 21/0204;
(Continued)

(56) References Cited

U.S. PATENT DOCUMENTS 2,677,460 A * 5/1954 Johnson ..... B65D 71/50 206/162
3,113,673 A * 12/1963 Stein ..... B65D 5/4275 206/813
(Continued)

FOREIGN PATENT DOCUMENTS

DE 23 31 193 1/1975
DE 102011106759 9/2012
(Continued)

OTHER PUBLICATIONS

Patent Translate powered by EPO and Google for DE102013105428 (8 pages of specification).*
(Continued)

*Primary Examiner* — Luan K Bui
(74) *Attorney, Agent, or Firm* — Occhiuti & Rohlicek LLP

(57) ABSTRACT

A pack includes at least four containers, each of which is in one of two container groups. Intragroup bonds hold containers in the same container group together. Intergroup bonds hold together the first and second groups. A carrying handle spans at least two containers from different groups.

19 Claims, 4 Drawing Sheets

(58) Field of Classification Search
CPC ..... B65D 21/0208; B65D 21/0205; B65B 17/02; B65B 17/025; B65B 27/04
USPC .... 206/142, 144, 192, 143, 166, 170; 383/6, 383/21
See application file for complete search history.

(56) References Cited

U.S. PATENT DOCUMENTS 3,388,791 A * 6/1968 Walsh ..... B65D 21/0205 206/162
3,759,373 A * 9/1973 Werth ..... B65D 21/0205 206/139
3,902,992 A * 9/1975 Schuster ..... B65D 21/0205 206/162
4,116,253 A * 9/1978 Watsky ..... A45C 13/26 150/108
5,044,515 A * 9/1991 Straub ..... B65D 71/50 206/144
5,092,456 A * 3/1992 Straub ..... B65D 71/50 206/144
2010/0308043 A1 12/2010 Wimmer
2016/0114919 A1* 4/2016 Johren ..... B65B 17/02 156/69

FOREIGN PATENT DOCUMENTS

DE 10 2011 107 265 1/2013
DE 10 2011 119 964 1/2013
DE 10 2013 105 428 11/2014
FR 2 286 763 4/1976

OTHER PUBLICATIONS

Patent Translate powered by EPO and Google for DE102013105428 (2 pages of claims).*
Patent Translate powered by EPO and/or Google for DE 102011107265 (A1).*

* cited by examiner

MULTIPACK HAVING ADHESIVELY BONDED CONTAINERS AND A CARRYING HANDLE

RELATED APPLICATIONS

This application is the national stage of PCT/EP2015/050236, which was filed on Jan. 7, 2016, which claims the benefit of the Jan. 12, 2015 priority date of German application DE 10-2015-100 342.2, the contents of which are herein incorporated by reference.

FIELD OF INVENTION

The invention relates to container packaging, and in particular, to groups of four or more containers that are adhesively bonded to form a pack, or "multipack."

BACKGROUND

Known container packs that have four or more adhesively-bonded containers are arranged in at least two rows. The containers are connected by adhesive bonds. Some of these adhesive bonds are able to sustain greater loads than other spots.

Each container of the pack comprises at least one bond that can be subjected to heavier loading. Bonds capable of being subjected to heavier loading are also arranged between the first and second rows. Bonds that sustain only lighter loads are often used to secure containers at the ends of rows.

The arrangement of bonds is elaborate and complex. As a result, it is difficult for a consumer to know the best order for releasing containers to minimize exertion of force.

SUMMARY

An object of the invention is to provide a pack from which a user can release individual containers with minimum exertion of force.

A multipack according to the invention comprises at least four containers that are divided into two groups. First-order bonds, or "intragroup bonds," bond together containers in the same group. Second-order bonds, or "intergroup bonds," bond containers that are from different groups. Each container is bonded to other containers by at least one intragroup bond. Two or more containers bond to other containers via intergroup bonds. A carrying handle spans upper ends of at least two containers, at least in sections. In general, containers in a group are arranged in a row. Thus, a pack with two groups will have two rows of containers.

Forming the pack includes bringing two groups together and bonding them with intergroup bonds. An intergroup bond is more easily released than an intragroup bond. This means that less force is required to release the intergroup bond than the intragroup bond.

A consumer would typically break the pack down into its constituent groups be breaking the intergroup bond, since it is these that would detach first. The consumer would then release a container by overcoming the intragroup bond.

A pack with the above features offers both minimal use of adhesive and a minimal number of adhesive-bonding locations at which to apply adhesive. Individual containers can be readily detached from the pack because, once the pack breaks into groups, it becomes significantly easier to access containers within.

In addition to this, the multipack according to the invention comprises a carrying handle that spans the upper ends of two containers. During transport the carrying handle stabilizes the multipack by spanning across two groups.

According to a further preferred embodiment of the invention, the carrying handle can be lengthened to form a carrying sling. This enables the pack to be carried more comfortably. For this purpose the carrying handle is folded or rolled up after the production of the multipack and spans the multipack when pulled by the consumer when needed. The pull exerted on the multipack when carrying is sufficiently high for the containers connected by adhesive to be held securely in the multipack.

According to a preferred embodiment of the invention, the intragroup bonds are on a lower half of the container. This creates a lever arm to assist the consumer in detaching a container. The lower the intragroup bonds are placed, the longer this lever arm will be.

Ordinarily, one would expect placement of bonds low on a container to destabilize the pack. However, as a result of a synergistic relationship between the bonds and the carrying handle, this is not the case. By spanning containers between different groups, the carrying handle significantly stabilizes the pack. In fact, it is only necessary to span two containers to achieve adequate stabilization. It is not, it turns out, necessary to span across two groups at multiple locations. This permits the omission of other stabilizers, such as cardboard or film. The result is a pack that is economical to make, easy to use, and generates little waste.

In some embodiments, intragroup bonds are stronger than intergroup bonds. This difference in bond strength can be using different adhesives, by applying adhesive in areas of different sizes, applying adhesive to form adhesive areas of different shapes, or combinations of any of the foregoing.

In some embodiment in which different geometries result in different bond strengths, the intragroup bond is made by forming adhesive areas that extend in directions parallel to the container's vertical axis.

In some embodiments, the containers in a container group form a row of containers. Packs formed from such groups are easy to manipulate during production and easy to break apart into constituent groups.

In a particularly economical embodiment, only selected containers have intergroup bonds. Preferably, these are the end containers of a group. It has been discovered that, as a result of a synergistic relationship between intragroup and intergroup bonds, it is possible to hold the groups together in a stable pack even with only a limited number of relatively weak intergroup bonds. This is particularly so when the intergroup bonds are at the end containers. When groups have more than five containers, it is preferable to have intergroup bonds at locations other than the ends of the group. However, it is not necessary to have intergroup bonds at each container to achieve the necessary stability.

The existence of groups with containers held by intragroup bonds appears to introduce a basic strength into the structure of the pack, as a result of which pack stability can be achieved by having intergroup bonds only at selected locations, such as between end containers of different groups.

In a preferred embodiment, intragroup bonds connect a first and a second container, as well as a third and fourth container while intergroup bonds connect the first and a third container as well as a second and a fourth container. Such a pack consists of two intragroup bonds and two intergroup bonds.

As used herein, containers include bottles, cans, tubes, sachets, in each case made of metal, glass, plastic, and/or a material composite, typically, for example, PET bottles, or a material composite of plastic, aluminum foil, and paper. Containers in the meaning of the invention are all materials, including such as those which are suitable for filling with fluid or viscous products. Containers that are already assembled into groups, or multipacks, are also included as containers. The containers of the multipack are preferably arranged in non-nesting positions or in positions such that the containers of a row of the multipack are not arranged in the gap formed between containers of an adjacent row of the multipack. The containers can have any desired cross-section, including oval, round, and polygonal. Although cylindrical containers are common, the container can be another shape, such as a sachet, a pyramid, or a parallelepiped.

A method for producing a multipack with the features described heretofore includes providing a first and a second arrangement of containers, applying adhesive spots on the containers, pressing the containers together so that intra-group bonds form first and second groups, with each group having a container that lacks an adhesive spot for an intragroup bond, applying an adhesive spot on at least one container in the first group, and pressing together the first and second groups so that an intergroup bond forms the pack.

In some practices, the intragroup bonds bond the group's containers along a line. Among these practices are those in that omit applying an adhesive spot to an end container. That end container would then bond to its neighbor via the neighbor's adhesive spot.

Forming an intragroup bond includes pressing or compressing two containers against one another so that and adhesive spot connects the two containers at an adhesive-bonding location.

As used herein, "adhesive" refers to any active substance that is applied in a fluid or viscous state and that is suitable for causing a force that tends to hold containers as a result of an interaction between the substance and the container's wall. These substances include self-adhesive substances that require nothing more than contact to develop such a force. However, it also includes substances that require assistance to develop such a force, for example via the application of energy or by partaking in a chemical reaction. These include substances that harden in the presence of radiation, such as UV radiation, or hot glue. In the case of hot glue, the container-joining operation must occur promptly because such a substance tends to lose its adhesive qualities as it cools. Other examples include substances that develop adhesive properties upon cross-linking or partaking in other chemical reactions.

The term "adhesive" also includes multi-layer materials, examples of which include those in which a substance having adhesive properties coats at least one carrier material. These multi-layer materials are typically formed as pads that are adhesive on both sides.

Practices of the invention include those in which the adhesive is applied as a point, a line, and a pattern of points and/or lines.

In a preferred practice, the adhesive is one having an adhesive strength that allows a container to be detached by hand from the pack. In particular, UV-hardening adhesives are suitable, since the adhesive strength that the adhesive develops at the adhesive-bonding location can be adjusted by changing the composition of the adhesive and the nature of the curing treatment.

Some practices also include connecting multipacks to each other. This is carried out using both intragroup bonds and intergroup bonds in the manner already described with the understanding that the nodes of the underlying lattice are merely being changed from containers to multipacks. Preferably, the bonds connect the multipacks directly to each other.

A suitable way to apply adhesive is through nozzles that apply or spray the mostly-fluid adhesive directly onto a container at one or more adhesion points. After the application of the adhesive, the containers are pressed against each other. This can be carried out using clamping strips that bring containers into contact.

In some practices, when an adhesion point is applied to a container, and when that adhesion point is brought into contact with a second container that does not have an adhesion point, an adhesive bond nevertheless forms.

In other practices, when two containers both have adhesion points, the bond is built up from two adhesion points.

The first and second groups are then pressed together to form the pack. Pressing causes the intergroup bond to form. Preferably, the intergroup bond forms at end containers. Finally, a carrier handle is positioned to span two containers. Preferably, the two containers are in the middle of the pack, with the containers belonging to different groups.

On a particular container, the intragroup bond and the intergroup bond are separated by ninety degrees along the container's circumference.

Intragroup bonds are stronger than intergroup bonds. This can be because the adhesive regions are bigger or shaped differently, or because the adhesive is different, or both. In some cases, the adhesive extends along lines that are parallel to the container's vertical axis. This results in a weak bond.

Finally, the invention comprises an apparatus for producing a multipack as described above. Such an apparatus includes means for conveying containers, means for application of adhesive, means for combining containers to form a multipack, and means for applying a carrying handle, wherein the means for conveying are configured such as to assemble a first and second grouping of containers, the first means for the application of adhesive are configured for applying an intragroup adhesion point onto a container, and that the means for merging are configured such as to merge, in each case, a first assemblage of containers to form a first group and a second assemblage of containers to form a second group, the second means for the application of adhesive are configured such as to apply an intergroup adhesion point onto a container, and the second means for merging are configured such as to merge a multipack from the first and second groups by creating an intergroup adhesive-bonding location from an intergroup adhesion point.

The means for producing an adhesion point include nozzles that either apply a fluid adhesive directly onto the containers or spray it on. Nozzles can be moved in such a way that they apply first and second adhesive-bonding locations, for example in circular and longitudinally extended form. It is preferable, however, for separate first and second means for application of adhesive to be arranged if intragroup and intergroup adhesion points are to be applied at different points on the containers. This arrangement is required, for example, if different adhesives with different adhesion strengths are being used to produce adhesive-bonding locations of the first and second order. However, for the application of adhesion points in different forms, separate means for producing adhesion points or adhesive-bonding locations are also helpful. As an alternative, the means for producing an adhesion point can also be configured as means for the application of two-sided adhesion pads.

The means for merging include contact dog elements, clamping strips or rails, or grippers. These press together the containers or groups that are to be merged such that the container walls come in contact with each other, and such that the adhesive at the adhesion points can be hardened or cross-linked to become adhesive-bonding locations. In the present case, the use of two different means for merging is advantageous, since the merging of groups of containers with intragroup adhesion points requires means for merging that are of different dimensions in relation to the merging of groups with intergroup adhesion points to form multipacks. A plurality of means for the merging of groups can be arranged upstream of a means for merging multipacks.

Finally, the device according to the invention comprises means for the application of a carrying handle that mostly comprise means for handling plastic strips and means for adhesive bonding of a plastic strip to two containers of a multipack. Advantageously, the means for adhesive bonding are configured in such a way that they each fix one end of the plastic strip to the upper end of a first and a second container, wherein the first and the second container preferably belong to different groups.

BRIEF DESCRIPTION OF THE DRAWINGS

These and other features of the invention will be apparent from the following detailed description and the accompanying figures, in which"

DETAILED DESCRIPTION

Figure 1:
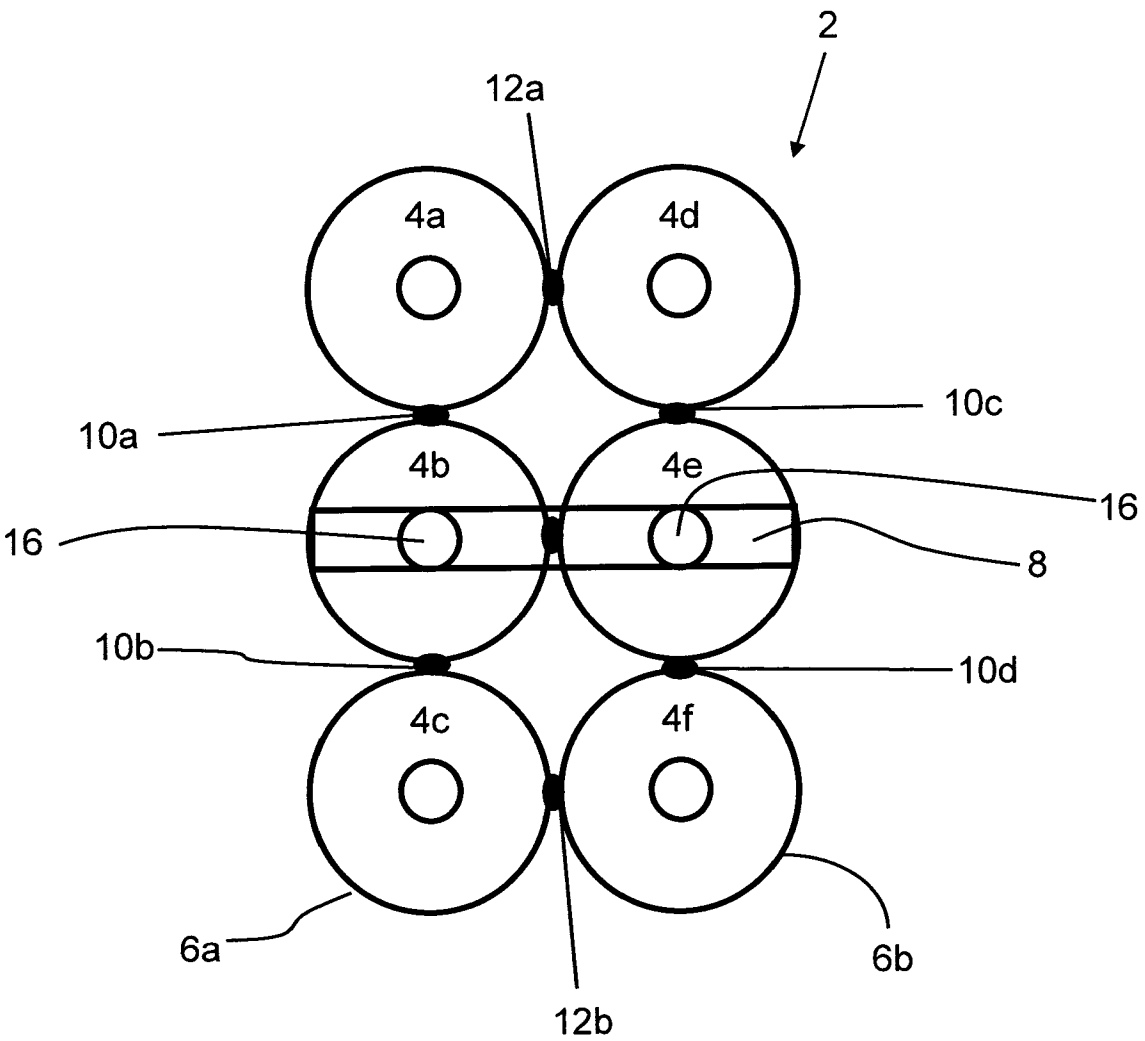
FIG. 1 shows a pack according to the invention.

FIG. 1 shows a container pack 2 having first through sixth containers 2*a*, 2*b*, 2*c*, 2*d*, 2*e*, 2*f*. The containers are, for example, bottles made of PET (polyethylene terephthalate) or cans made of aluminum.

The container pack 2 has first and second container groups 6*a*, 6*b*. A group 6*a*, 6*b* has three containers arranged in a row. In FIG. 1, the first through third containers 4*a*, 4*b*, 4*c* form the first group 6*a*, and the fourth through sixth containers 4*e*, 4*d*, 4*f* form the second group 6*b*. Within each group 6*a*, 6*b* the containers are arranged in a non-nesting arrangement to form the pack 2. In the arrangement shown, the pack 2 has two ends, each two containers wide, and two faces, each three containers wide.

A carrying handle 8 stretches across the pack 2 midway along a line that extends between its ends. In the pack 2 shown in FIG. 1, the carrying handle extends over upper ends 16 of the second and fourth containers 4*b*, 4*d* along a midline that connects the two faces. The carrying handle 8 consists of a strip of plastic that can be lengthened to form a loop for enabling a consumer to grasp it without interference from the upper ends 16 of the second and fourth containers 4*b*, 4*d*.

Figure 2:
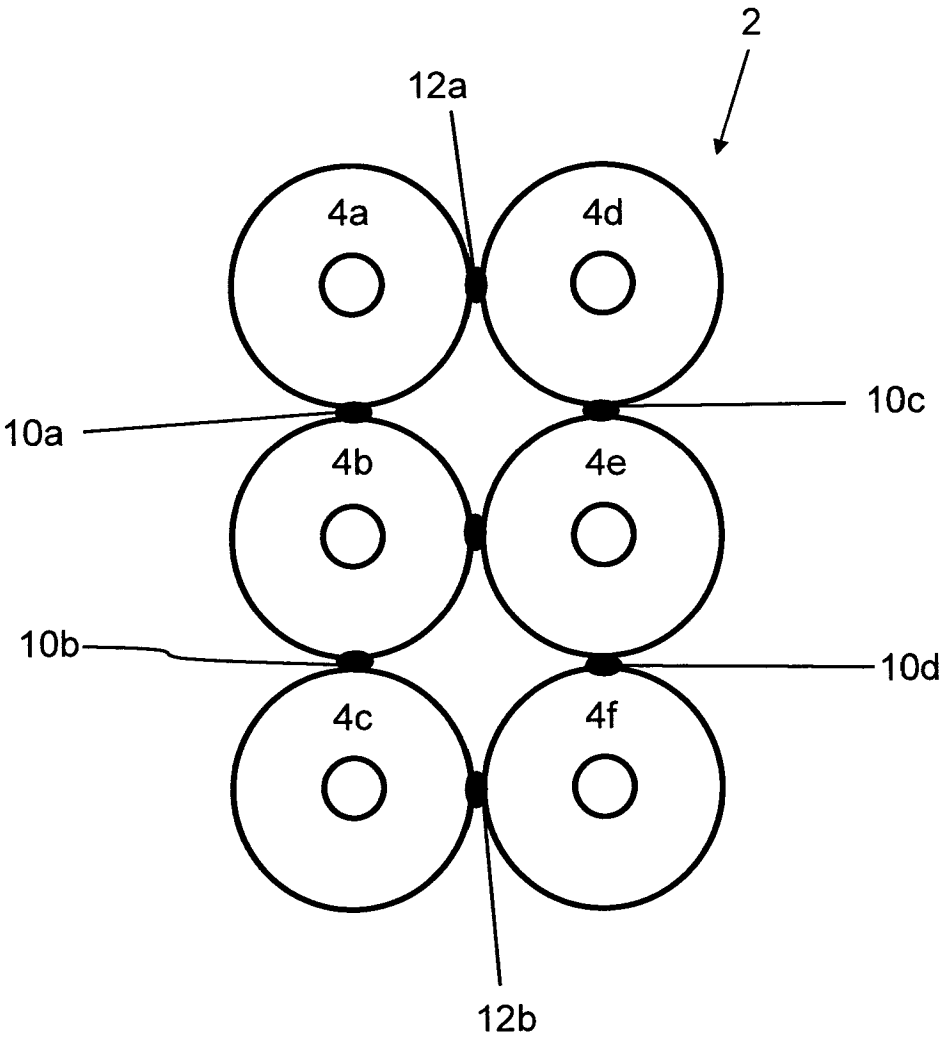
FIG. 2 shows the pack of FIG. 1 after having removed the carrying handle.

FIG. 2 shows the pack from FIG. 1, but after the removal of the carrying handle 8. This enables one to clearly see the bonds. There are two kinds of adhesive-bonds: intragroup bonds 10*a*, 10*b*, 10*c*, 10*d* and intergroup bonds 12*a*, 12*b*. The intragroup bonds 10*a*, 10*b*, 10*c*, 10*d* connect containers within a group to each other. The intergroup bonds 12*a*, 12*b* connect groups to each other.

Within the first group 6*a*, intragroup bonds 10*a*, 10*b* are formed by applying adhesive spots onto the first and second containers 4*a*, 4*b* and by then merging the first, second, and third containers 4*a*-4*c* in a row. Drying or hardening the adhesion spots then forms the intragroup bonds 10*a*, 10*b*. The third container 4*c* does not have any adhesion spot. It connects to the second container 4*b* by way of the spot that was applied to the second container 4*b*.

The second group 6*b* is produced in the same way as the first group 6*a*.

The intergroup bonds 12*a*, 12*b* are produced from the same adhesive as that used for the intragroup bonds 10*a*-10*d*. However, spots used to make the intergroup bonds 12*a*, 12*b* are perceptibly smaller size than those used to make the intragroup bonds 10*a*-10*d*.

For a particular container, ninety degrees of arc, as measured along the container's wall, separate the intragroup bond 10*a*, 10*b*, 10*c*, 10*d* from the intergroup bond 12*a*, 12*b*. The intragroup bonds 12*a*, 12*b* are arranged between the respective corner containers 4*a*, 4*c*, 4*d*, 4*f*. This arrangement ensures that the pack 2 can be manufactured easily and economically.

With the carrying handle 8 having been removed, it is easy to separate the pack 2 into its first and second groups 6*a*, 6*b*. This is because the intergroup bonds 12*a*, 12*b*, as a result of their smaller size, are weaker than the intragroup bonds 10*a*, 10*b*, 10*c*, 10*d*.

Figure 3:
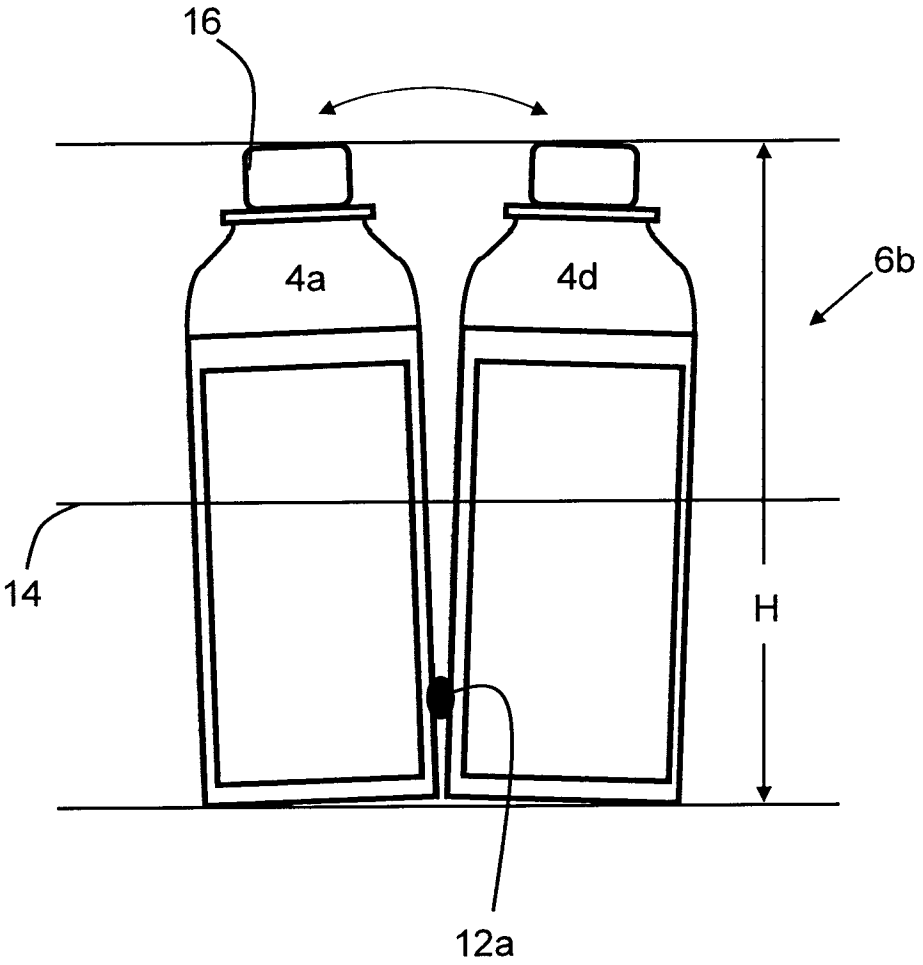
FIG. 3 shows an end view of the pack of FIG. 1 as two containers are being separated.

Referring now to FIG. 3, in a preferred embodiment, the intergroup bonds 12*a*, 12*b* are located below a container midline 14. This creates a long lever arm that makes breaking the pack 2 into its constituent groups 6*a*, 6*b* easier. This same placement is also used for intragroup bonds 10*a*, 10*b*, 10*c*, 10*d* to make separation of containers 4*a*, 4*b*, 4*c* within a group 6*a* easier as well.

Even without the carrying handle 8, the pack 2 holds together well thanks to the combined action of the intergroup bonds 12*a*, 12*b* and the intragroup bonds 10*a*, 10*b*, 10*c*, 10*d*. The carrying handle 8 further improves the pack's stability. It does so even though it only spans two containers 4*b*, 4*e*.

Figure 4:
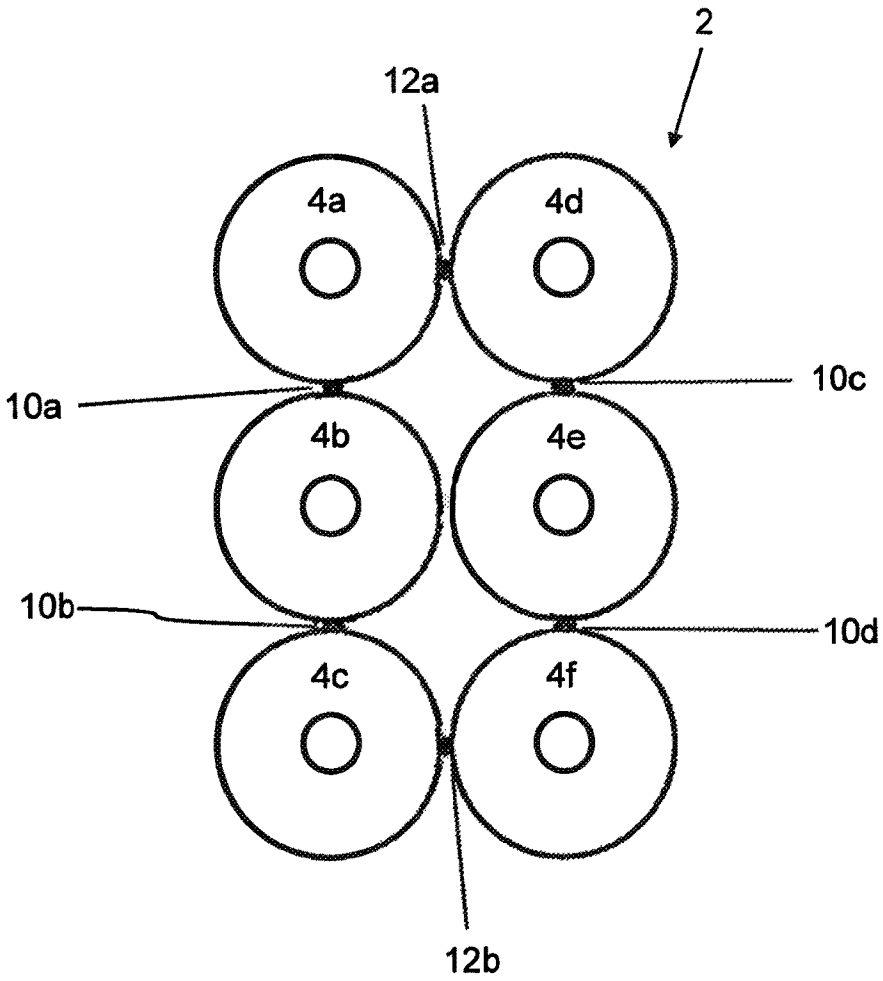
FIG. 4 shows a view from above of the pack in FIG. 1 after having been broken into its two constituent groups.

Referring now to FIG. 4, once the pack 2 has been separated into its constituent groups 6*a*, 6*b*, it is also possible to separate containers 4*d*, 4*e*, 4*f* within a group 6*b* from each other by rotating the containers 4*d*, 4*e*, 4*f*.

The sequence of breaking down of the pack 2 includes removing the carrying handle 8, breaking the pack 2 into groups 6*a*, 6*b* by detaching the intergroup bonds 12 that connect the groups 6*a*, 6*b*, and breaking up the groups 6*a*, 6*b* by detaching an individual container 4*a*, typically by rotating but also by applying a leveraging force to its upper end 16 using the intragroup bond 12*a* as a fulcrum of a lever arm that extends to the upper end 16. Once the groups 6*a*, 6*b* are separated, this sequence advantageously allows the consumer to only have to detach a single bond. This allows a container 4*a*, 4*c*, 4*f*, 4*d* in an end position, which as a rule is connected by two bonds to other containers of the pack 2, to be detached individually with very little exertion of force.

Another advantage arises because the groups 6*a*, 6*b* are easily-handled units from which consumers can detach individual containers 4*a*-4*f* without having to hold, lift, or manipulate the entire pack 2. This also allows weaker consumers, such as children, to break up a pack 2 with little exertion of strength.

A production method for forming the pack 2 includes a station for the application of a carrying handle 8. Such a station holds the containers 4*a*-4*f* of the pack 2 using suitable holding-and-gripping means. This can be carried out while the containers 4*a*-4*f* are stationary or advantageously during transport of the container group 6*a*, 6*b* being formed into a pack 2. Accordingly, the station for applying the carrying handles is ideally an integral constituent part of the hardening-and-drying station or segment, or arranged along this hardening-and-drying station or segment.

Having described the invention, and a preferred embodiment thereof, what is claimed as new, and secured by letters patent is:

The invention claimed is:

1. A manufacture comprising a container pack having first and second container-groups, a first set of bonds, a second set of bonds, intergroup bonds, a carrying handle, and at least six containers, wherein each of said containers is in one of said first and second container-groups, wherein said carrying handle has ends that are attached to containers from different container-groups, wherein said bonds in said first set of bonds are intragroup bonds that bond containers in said first container-group to each other, wherein said bonds in said second set of bonds are intragroup bonds that bond containers in said second container-group to each other, wherein said intergroup bonds bond said first and second container-groups to each other, and wherein said intergroup bonds are arranged only on lower halves of said containers.

2. The manufacture of claim 1, wherein each of said intragroup bonds has an intragroup binding strength, wherein each of said intergroup bonds has an intergroup binding strength, and wherein said intragroup binding strength exceeds said intergroup binding strength.

3. The manufacture of claim 1, wherein there exist containers in different container-groups that are not end containers and that do not have an intergroup bond between them.

4. The manufacture of claim 1, wherein said first and second container-groups each have at least three containers, wherein all containers are in one of said first and second container groups, and wherein there exist pairs of containers in different container-groups that do not have an intergroup bond between them.

5. The manufacture of claim 1, wherein said intergroup bonds are smaller than said intragroup bonds.

6. The manufacture of claim 1, wherein said intergroup bonds and said intragroup bonds are placed only below midlines of said containers.

7. The manufacture of claim 1, wherein said carrying handle is one that can be lengthened to form a sling and wherein said carrying handle is folded or rolled and spans said container pack when pulled on by a consumer.

8. The manufacture of claim 1, wherein the carrying handle is a strip of plastic that, when lengthened, forms a loop to permit grasping by a consumer without interference from upper ends of said containers.

9. The manufacture of claim 1, wherein there exists a first number of intergroup bonds arranged on lower halves of said containers, wherein there exists a second number of intergroup bonds arranged on upper halves of said containers, wherein said first number is greater than said second number, and wherein said second number is zero and wherein, as a result of said intergroup bonds being only on lower halves of said containers, the product of the number of intergroup bonds on said lower halves and the number of intergroup bonds on said upper halves is zero.

10. The manufacture of claim 1, wherein arranging said intergroup bonds only on said lower halves destabilizes said container pack.

11. The manufacture of claim 1, wherein each of said intergroup bonds is placed to define a lever arm, wherein said lever arm assists a consumer in detaching a container that is held to another container by an intergroup bond, and wherein said lever arm has a length that depends on a position of said intergroup bond on a lower half of said container.

12. The manufacture of claim 1, wherein said intergroup bonds consist of intergroup bonds that are on lower halves of said containers.

13. The manufacture of claim 1, wherein said intergroup bonds consist of a first set of intergroup bonds and a second set of intergroup bonds, wherein said first set consists of intergroup bonds that are on lower halves of said containers, wherein said second set consisting of intergroup bonds that are on upper halves of said containers, and wherein said second set is an empty set.

14. The manufacture of claim 1, wherein said carrying handle stabilizes said container pack.

15. A manufacture comprising a container pack having first and second container-groups, a first set of bonds, a second set of bonds, intergroup bonds, a carrying handle, and at least four containers, wherein each of said containers is in one of said first and second container-groups, wherein said carrying handle has ends that are attached to containers from different container-groups, wherein said bonds in said first set of bonds are intragroup bonds that bond containers in said first container-group to each other, wherein said bonds in said second set of bonds are intragroup bonds that bond containers in said second container-group to each other, wherein said intergroup bonds bond said first and second container-groups to each other, and wherein said first and said second container-groups each have at least three containers and wherein said intergroup bonds exist only between end-position containers of said first and second container-groups.

16. A manufacture comprising a container pack having first and second container-groups, a first set of bonds, a second set of bonds, intergroup bonds, a carrying handle, and at least four containers, wherein each of said containers is in one of said first and second container-groups, wherein said carrying handle has ends that are attached to containers from different container-groups, wherein said bonds in said first set of bonds are intragroup bonds that bond containers in said first container-group to each other, wherein said bonds in said second set of bonds are intragroup bonds that bond containers in said second container-group to each other, wherein said intergroup bonds bond said first and second container-groups to each other, and wherein said container pack comprises six containers and wherein only end containers have intergroup bonds.

17. A manufacture in which intergroup bonds are disposed only on lower halves of containers, wherein said intergroup bonds attach a first container-group of a container pack to a second container-group of said container pack, said container pack comprising six containers, wherein intragroup bonds from a first set of intragroup bonds hold containers that are in said first container-group to each other, wherein intragroup bonds from a second set of intragroup bonds hold containers that are in said second container-group to each other, wherein a carrying handle has a first end that is attached to a container from said first container-group and a second end that is attached to a container that is in said second container-group, wherein said container pack is a constituent of said manufacture, and wherein said intergroup bonds, said intragroup bonds, said first and second container-groups, and said carrying handle are all constituents of said container pack.

18. A method comprising producing a container pack comprising six containers, wherein producing said container pack comprises applying adhesive to at least four of said containers, pressing said containers together to form first and second sets of bonds, said first set of bonds being intragroup bonds that join containers to form a first container-group and said second set of bonds being intragroup bonds that join containers together to form a second container-group, wherein each of said containers is in one of said first and second container-groups, forming intergroup bonds to bond said first and second container groups to each other, wherein said intergroup bonds are arranged only on lower halves of said containers, and attaching ends of a carrying handle to containers from different container-groups.

19. The method of claim 18, said method further comprising connecting end-position containers of said first and second container-groups with an intergroup bond and leaving containers other than said end containers unconnected by an intergroup bond.

* * * * *